US006326861B1

(12) United States Patent
Villa

(10) Patent No.: US 6,326,861 B1
(45) **Date of Patent: *Dec. 4, 2001**

(54) METHOD FOR GENERATING A TRAIN OF FAST ELECTRICAL PULSES AND APPLICATION TO THE ACCELERATION OF PARTICLES

(75) Inventor: Francesco Villa, Los Gatos, CA (US)

(73) Assignee: FELtech Corporation, New York, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/400,556

(22) Filed: Sep. 21, 1999

Related U.S. Application Data

(60) Provisional application No. 60/144,068, filed on Jul. 16, 1999.

(51) Int. Cl.[7] ..... H05H 9/00

(52) U.S. Cl. ..... 333/20; 315/505

(58) Field of Search ..... 333/20; 307/106; 327/105, 106, 107; 315/505

(56) References Cited

U.S. PATENT DOCUMENTS

| | | | | |
|---|---|---|---|---|
| 4,155,017 | * | 5/1979 | Gaule et al. | 307/268 |
| 4,598,415 | | 7/1986 | Luccio et al. . | |
| 4,888,556 | | 12/1989 | Buttram et al. . | |
| 4,893,089 | | 1/1990 | Villa . | |
| 4,918,325 | * | 4/1990 | Busby et al. | 307/106 |
| 4,972,420 | | 11/1990 | Villa | 372/2 |
| 5,089,785 | | 2/1992 | Hand . | |
| 5,150,067 | | 9/1992 | McMillan . | |
| 5,239,309 | * | 8/1993 | Tang et al. | 342/13 |
| 5,347,209 | * | 9/1994 | Payne et al. | 323/271 |
| 5,381,072 | | 1/1995 | Tanabe | 315/5.41 |
| 5,422,549 | | 6/1995 | Shepard et al. | 315/505 |
| 5,637,966 | | 6/1997 | Umstadter et al. | 315/507 |
| 5,659,228 | | 8/1997 | Ueda | 315/505 |
| 5,719,478 | | 2/1998 | Washio et al. | 315/500 |
| 5,744,919 | | 4/1998 | Mishin et al. | 315/505 |
| 5,757,146 | | 5/1998 | Carder | 315/505 |
| 5,789,865 | | 8/1998 | Yu et al. | 315/5.39 |
| 5,789,876 | | 8/1998 | Umstadter et al. | 315/507 |
| 5,796,219 | | 8/1998 | Hirakimoto et al. | 315/500 |
| 6,043,607 | * | 3/2000 | Roderick | 315/111.21 |

OTHER PUBLICATIONS

A. Luccio et al., "Coherent Compton X–Ray Sources "; *Journal of X–Ray Science and Technology 4*; pp. 247–262; 1994.

* cited by examiner

*Primary Examiner*—Justin P. Bettendorf
(74) *Attorney, Agent, or Firm*—Ostrolenk, Faber, Gerb & Soffen, LLP

(57) ABSTRACT

A method for generating a closely spaced train of extremely high voltage short pulses. The method involves generating the train of pulses by combining a plurality of harmonic amplitudes to construct said pulses, via a Fourier construction. Any arbitrary pulse shape can be reproduced simply by changing the amplitude of the harmonics. The train of high voltage electrical pulses produced by the method of the present invention is particularly well suited for the acceleration of particles by applying the pulses to an appropriate accelerating structure.

2 Claims, 7 Drawing Sheets

$G_{1,2,3,\text{ETC.}}$ = SINUSIDAL GENERATOR
$F_{1,2,3,\text{ETC.}}$ = TUNED FILTERS
L = LOAD
AT = AUTOTRANSFORMER $G_{1,2,3,\ ETC.}$ = SINUSIDAL GENERATOR
$F_{1,2,3,\ ETC.}$ = TUNED FILTERS
L = LOAD
AT = AUTOTRANSFORMER

METHOD FOR GENERATING A TRAIN OF FAST ELECTRICAL PULSES AND APPLICATION TO THE ACCELERATION OF PARTICLES

This application claims the benefit of U.S. Provisional Application Serial No. 60/144,068, filed on Jul. 16, 1999.

BACKGROUND OF THE INVENTION

1. Field of the Invention

The present invention relates to the field of particle accelerators and applications in the field of high peak power electronics. More particularly, the invention relates to a technique for obtaining a closely spaced train of extremely high voltage short pulses.

2. Description of the Related Art

Electrons can be accelerated to high energies in a short distance by applying to a suitable accelerating structure a closely spaced train of extremely high voltage short pulses. The requirement of very short pulses is dictated by the need of sustaining ultrahigh electric fields in the accelerating structure, whether conducting or superconducting. Short pulses are usually produced in prior art techniques by switching a pulse forming structure on an electrical load. However, with very few exceptions, switching does not allow a high repetition rate of the high voltage pulses.

Many uses of fast repetitive pulses are described in the literature. For many of these applications, the repetition rate, i.e., the interval between two successive short pulses, is either too long, or the pulse train is composed of few short pulses. This is due to the fact that switching an energy storage device on a load stresses the switch at levels often close to destructive breakdown.

Accordingly, a need exists for a method for producing a closely spaced train of extremely high voltage short pulses which does not require switching as in prior art techniques.

SUMMARY OF THE INVENTION

The present invention is based upon the following rational and basic facts:

1) High fields can be held for short times in vacuum between metallic (normal) electrodes.

2) High fields can be held for short times in vacuum between high temperature superconducting electrodes.

3) High fields can be held for short times in vacuum between conventional superconducting electrodes.

4) An electric field changing in time has an associated magnetic field. In a plane wave, the ratio of the electric field intensity to magnetic field is simply the speed of light. A non-static high electric field is associated with a high magnetic field.

5) The critical magnetic field Hc (at which the transition superconducting-to-normal occurs) of a superconductor scales as the temperature difference between the transition temperature at zero field and the actual temperature. The highest transition temperature for normal superconductors is around 20 degrees Kelvin. The transition temperature of high temperature superconductors is around 100 degrees Kelvin. High temperature superconductors are the most promising candidate for efficient, ultrahigh field accelerators, because they can sustain high magnetic fields without reverting to normal conductors.

6) Superconducting electrode structures offer the highest efficiency of conversion from electromagnetic energy to accelerated beam energy. No other structure can offer the same efficiency. Conventional superconductors are used for acceleration, but with a maximum gradient of ~30 MV/m (not yet limited by Hc, but close).

7) Pulse power technology produces extremely short pulses (less than one nanosecond and as short as 50–100 picoseconds). The repetition rate of these pulses does not exceed a few hundred/seconds. For many applications, this repetition rate is too low.

The present invention provides a method for generating a high frequency train of high voltage pulses by using a Fourier construction, rather than switching to produce the pulse train. Thus, the method of the invention involves generating the train of pulses by combining a plurality of harmonic amplitudes to construct the pulses, via a Fourier construction. Any arbitrary pulse shape can be reproduced simply by changing the amplitude of the harmonics.

The closely spaced train of extremely high voltage short pulses generated by the method of the present invention can be applied to conventional accelerating structures or, preferably, to superconducting structures for accelerating particles. At lower power levels, the method of the present invention can be used to produce a train of ultrashort pulses that may have applications in many fields of electronics, for instance to drive solid state lasers at high peak power, or to drive Pockel cells, high power broad spectrum radar, etc.

Other features and advantages of the present invention will become apparent from the following description of the invention which refers to the accompanying drawings.

DETAILED DESCRIPTION OF THE PREFERRED EMBODIMENTS

Introduction

Figure 1:
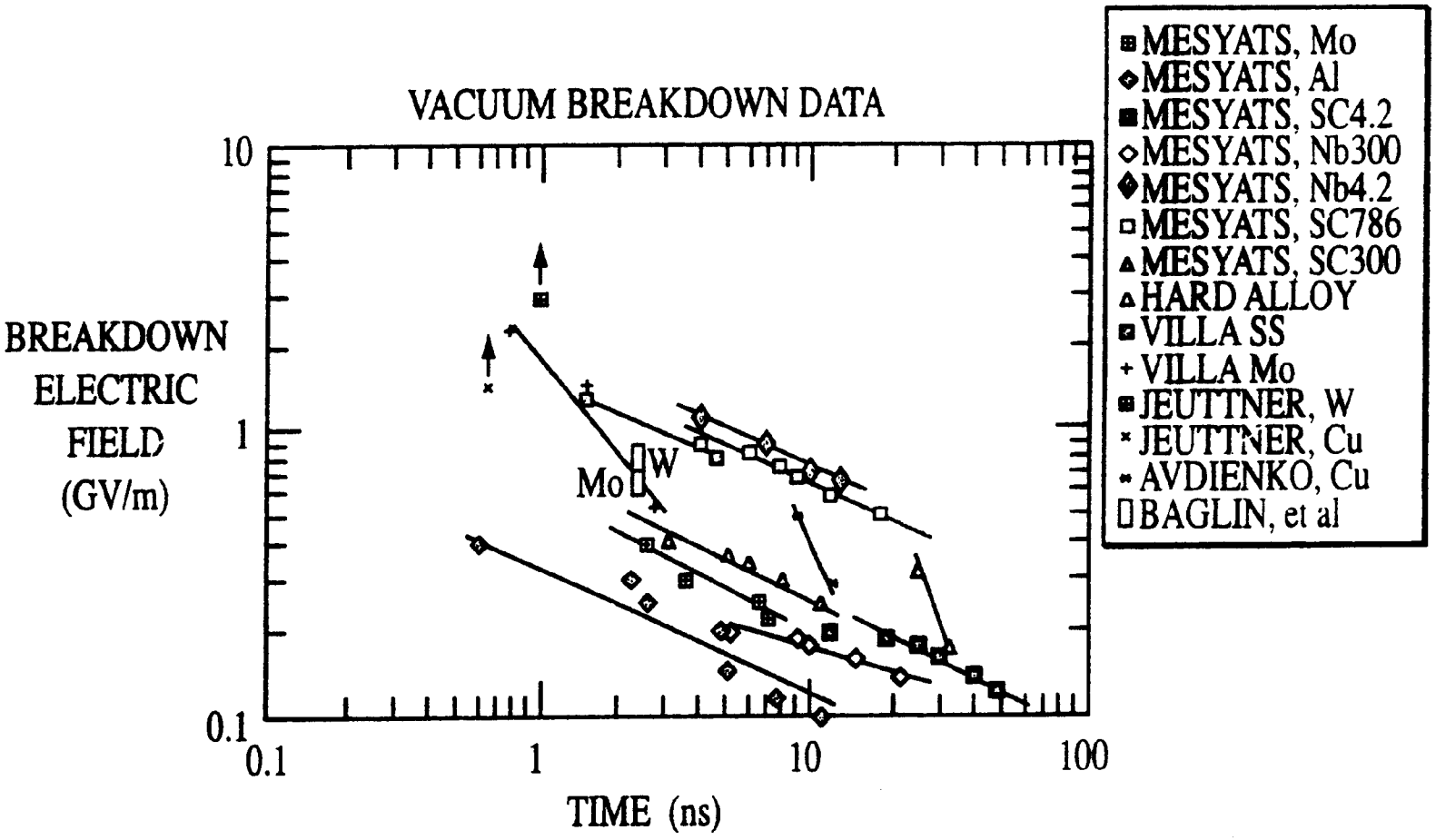
FIG. 1 sets forth a compendium of the available data showing that when an electric field is applied to conventional electrode structures for a very short time, the regenerative events which ordinarily result in breakdown do not occur.

1) Benefits of High Field Electron Acceleration

High field electron acceleration is necessary and beneficial for the following reasons:

1) The higher the field (especially in the initial phase of acceleration, when electrons are not yet very relativistic), the better the brilliance and emittance of a particle (electron) beam. Emittance and brilliance are two parameters used to describe the "quality" of a particle beam.

The emittance of a beam has been related to the degree of order, or temperature, of the beam. A low emittance reflects a well ordered beam, a cold beam. For example, an electron beam in which all the electrons are traveling exactly parallel to each other, and all have the same energy, has zero emittance. The emittance value can be related to the transverse beam size in an arbitrary transport channel; in particular, a beam with very low emittance can be focused to a very small spot. Low emittance is necessary in many instances. For example, in the case of an electron beam driving a free electron laser, there is a direct relationship between the emittance $\epsilon$ of the beam and the shortest wavelength $\lambda$ at which the free electron laser can produce coherent radiation:

$$\varepsilon = \frac{\lambda}{4\pi}$$

2) For a given final energy, the length, and thus the cost of an accelerator are reduced as the inverse of the field $$E\left(L \propto \frac{1}{E}\right).$$

For a free electron laser, for a given lasing wavelength the length of the accelerator scales as the inverse of the field squared:

$$L \propto \frac{1}{E^2},$$

because the emittance scales as as 1/E.

(3) Especially during the initial phase of acceleration, it is very important to have high electric field. The high field allows large currents to be extracted from a cathode for two reasons:

(i) Schottky assisted photoemission of electrons from a metal cathode into the vacuum of an accelerator) increases the quantum efficiency as the square root of the applied field. If the electric field increases by a factor of one hundred, the quantum efficiency is increased by a factor of ten. This reduces the amount of laser power needed to extract a given current in a photocathode gun by the same factor of ten.

(ii) Electron current extracted in vacuum from a cathode in a planar diode geometry is limited by space charge. In a diode geometry, according to Child-Langmuir law (Child's law is not correct for relativistic diodes, but the difference between the Child's expression and the relativistic case is on the order of 25% at energies around 3 MeV), the extracted current density is limited to a value J given by:

$$J = C\frac{V^{\frac{3}{2}}}{d^2} \quad C = 2.336\times10^{-6}\ \text{ampvolt}^{-\frac{3}{2}} \tag{1}$$

where J is the current density, (in Amperes/cm$^2$), d the anode-cathode distance (in centimeters), V the applied voltage (in volts). This limit is determined by the fact that the electric field at the cathode is shielded by the charge filling the anode-cathode space: when the current density reaches the Child-Langmuir limit, the electric field on the cathode's surface is zero, and therefore the emission ceases. If the emission is not uniform over the cathode area, but limited to an area of radius r, less than the anode-cathode distance d, the equation (1) is modified as $$J = C\frac{V^{\frac{3}{2}}}{d^2}\left(\frac{d}{r}\right)^{\frac{1}{2}} \tag{2}$$

Since E=V/d, we obtain for the maximum current $$I = C\pi\left(\frac{Vr}{d}\right)^{\frac{3}{2}} = C\pi(Er)^{\frac{3}{2}} \tag{3}$$

This expression is approximately valid for r≦d, for non-relativistic electrons. There is no close form for the complete expression for relativistic electrons, short times and arbitrary shape electrodes.

The minimum emittance of an electron bunch extracted from a cathode at a temperature T is:

$$\varepsilon_T = 2\pi\sigma_T\left(\frac{kT}{\text{mc}^2}\right)^{\frac{1}{2}} \tag{4}$$

Eq. (3) gives the maximum current and (4) the minimum emittance. Following the definition of brilliance:

$$B = \frac{I}{\varepsilon_T^2} \tag{5}$$

and remembering that $$r = A\sigma_T$$

where A is a constant mainly due to the definition of $\sigma_T$ and r, the dependence of the upper limit for beam brilliance as a function of the electric field is obtained as:

$$B = \frac{A^2Cmc^2}{4\pi kT}\left(\frac{E^3}{r}\right)^{\frac{1}{2}} \tag{6}$$

Again, this is the maximum brilliance, because many effects contribute to the loss of emittance, and because the longitudinal emittance for a current equal to Child's limit is, for most practical purposes, unacceptable.

In practice, the current extracted will be substantially less than the Child's limit. The emittance will be higher than the thermal minimum, due to space charge effects. The space charge emittance growth has been calculated by K. J. Kim, 1989 *Nuclear Instruments and Methods*, A275,201, as:

$$\varepsilon_T = \frac{Z_0}{8}\frac{I}{E}\mu(S) \tag{7}$$

This expression is valid for values of the current well below the Child's limit. $Z_0$ is the so called vacuum impedance, I is the current, and $\mu$(S) is a geometrical factor that depends on the ratio of longitudinal to transverse dimensions of the electron bunch. Equation (7) has been shown to fit well experimental data (from F. Villa, A. Luccio, "Test of a High Gradient, Low Emittance Electron Gun", *Laser and Particle Beams* (1997), vol. 15, No. 3, pp. 427–447). Using Equations (3), (5), (7), a scaling for the brillance is obtained as $$B \propto \left(\frac{E}{r^3}\right)^{\frac{1}{2}}, \tag{8}$$

assuming $\mu(S)=1$. These conclusions, i.e., Equation (6) and Equation (8), appear to be quite different. However, even a square root dependence of the brilliance is effective: a factor of 100 in field (E) improves the brilliance by a factor of 10. In practice, the two expressions are not (quantitatively) very different, because some E dependence, for a given emittance, is hidden in the parameter $\mu(S)$, and because the range of current I in which the formulas are applicable affects the value of r.

2) Breakdown

When an electric field is generated in vacuum in a conducting structure, there is a threshold value of the field above which the structure breaks down. Sometimes the breakdown is so energetic that the structure is damaged. The breakdown mechanism is fairly well understood, but the initiation of the process is still subject to debate. The breakdown threshold also depends on many parameters of the stressed surfaces (preparation, smoothness, chemical treatment, crystalline form of the metal, polishing technique, etc.).

3) Difficulties with High RF Fields.

An extensive body of experimental work has been published on the subject of breakdown field in an accelerator structure (typically a succession of cylindrical cavities) filled with radio frequency (RF) power. The experimental evidence shows that before catastrophic breakdown there is a current extracted from the structure, at times so large that the actual electron beam cannot be detected above background. This current depends on many factors, including the cleanliness of the surfaces, the partial pressure of residual gas in the vacuum system, the duration of "conditioning" and many others. All of the data are for structures made of copper (the material of choice for non-superconducting structures) in various states of surface smoothness and cleanliness. The possible effects of different metals on the surface of the cavities has not been studied with RF.

The data are consistent with the following scenario: As soon as the RF power is applied to the accelerating structure, the electric field starts to grow, at a rate proportional to the input power. After some time (of the order of a few thousand RF oscillations), the field reaches a value sufficiently high to extract some electrons from the conducting surface. This occurs at a relatively low electric field, well below the field required by Fowler-Nordheim tunneling. In fact, there are many mechanisms responsible for emission at "low" macroscopic fields. One of them, and indeed still the favorite, is the presence of microscopic sharp metallic protrusions. These protrustions are responsible for the conditioning effects. The conditioning of a structure is a gradual increase of the voltage breakdown, following the application of gradually increasing electric fields, well below breakdown. Actually, it appears that most of the electrons are emitted by i) a dislocation in the crystalline structure of the electrode of ii) a small piece of semiconductor or insulating material embedded in the electrode's surface.

These electrons are accelerated and impinge on the surface of the structure, where they can produce X-rays and/or other secondary electrons. The X-rays can extract more electrons from other regions, and the electrons are accelerated again, and the avalanche process repeats itself until there is a substantial current. If the electric field continues to increase, the extracted current will eventually grow to such a high value to produce catastrophic breakdown. The main prediction of this scenario is the beta dependence on pulse length. Beta is the ratio between the field calculated from FN emission and the actual macroscopic field. Typical values for very clean, well conditioned surfaces are of the order of 50–100, with a low value record of 20. Since the current is extracted and then amplified by regenerative effects, the value of beta will tend to go to 1 when the pulse length becomes extremely short. This is a fundamental point. Therefore, the first problem with RF is that the maximum electric field is limited by regenerative processes, which become more and more effective (in producing an unwanted electron current) for longer and longer RF pulses.

Some authors have inferred from the experimental data a linear dependence of the breakdown field on frequency. Although there may be a weak dependence of the breakdown field as a function of frequency, there is no physical justification for such dependence. Indeed, the data show that the strong dependence is on the RF pulse duration, i.e., the time that the RF power is applied to the structure. This fact appears evident if one uses all the data available in the literature, not only those agreeing with a linear functional dependence upon frequency. Generally, the RF pulse envelope becomes shorter and shorter at higher frequencies, because the filling time of the structure is a fixed number of periods, roughly equal to the Q factor of the structure. Hence at higher frequencies, the time (during which the high voltage is applied) is shorter, and the voltage holding increases.

The second problem is the need for RF sources capable of extremely high power, to reach high accelerating fields. Many ingenious inventors have "compressed" the power available from RF sources, but their implementation is not trivial or inexpensive Present realistic limits of RF acceleration are in the range of 100 MV/m for frequencies of several gigahertz.

Short Pulse Acceleration

1) Pulse Breakdown in Vacuum (Conventional Electrodes).

When the electric field is applied to a structure for a very short time, the regenerative processes responsible for the extraction and subsequent amplification of the (unwanted field emission) current do not take place, because there is little or no time available for many regenerative events to occur. This effect is well known from experimental data available in the published literature. FIG. 1 shows a compendium of the available data for different electrodes and from many different authors (from F. Villa, A. Luccio, "Test of a High Gradient, Low Emittance Electron Gun", *Laser and Particle Beams* (1997), vol. 15, No. 3, pp. 427–447). The general trend of higher field for shorter pulse duration is evident. The upright pointing arrows for two experimental points means that breakdown was not reached. The dashed area (i.e., for times less than 0.4 nanoseconds) is the region in which accelerating fields of the order of 3 GV/m can be held safely with a good margin. Notice that 100 MV/m is reached (under pulse) for a time of the order of 100 ns.

High fields in presence of large accelerated current extracted from a cathode have been demonstrated (see the article by F. Villa and A. Luccio cited above). The field obtained, without any hint of breakdown, was 2.7 GV/m, for 120 ps., or 27 times higher than the 100 MV/m. Others have obtained 1 GV/m, for a time of 1 ns. (T. Strinivasan-Rao, J. Smedley, "Table Top, pulsed, relativistic electron gun with GV/M gradient," *Proceedings of Advanced Accelerator Concept*, (*Seventh Workshop*) *AIP Conference Proceedings* 398, Lake Tahoe, Calif., October 1996, L. C. Catalog Card #97-72788).

2) Pulse Breakdown in Vacuum (Superconducting Electrodes)

Figure 2:
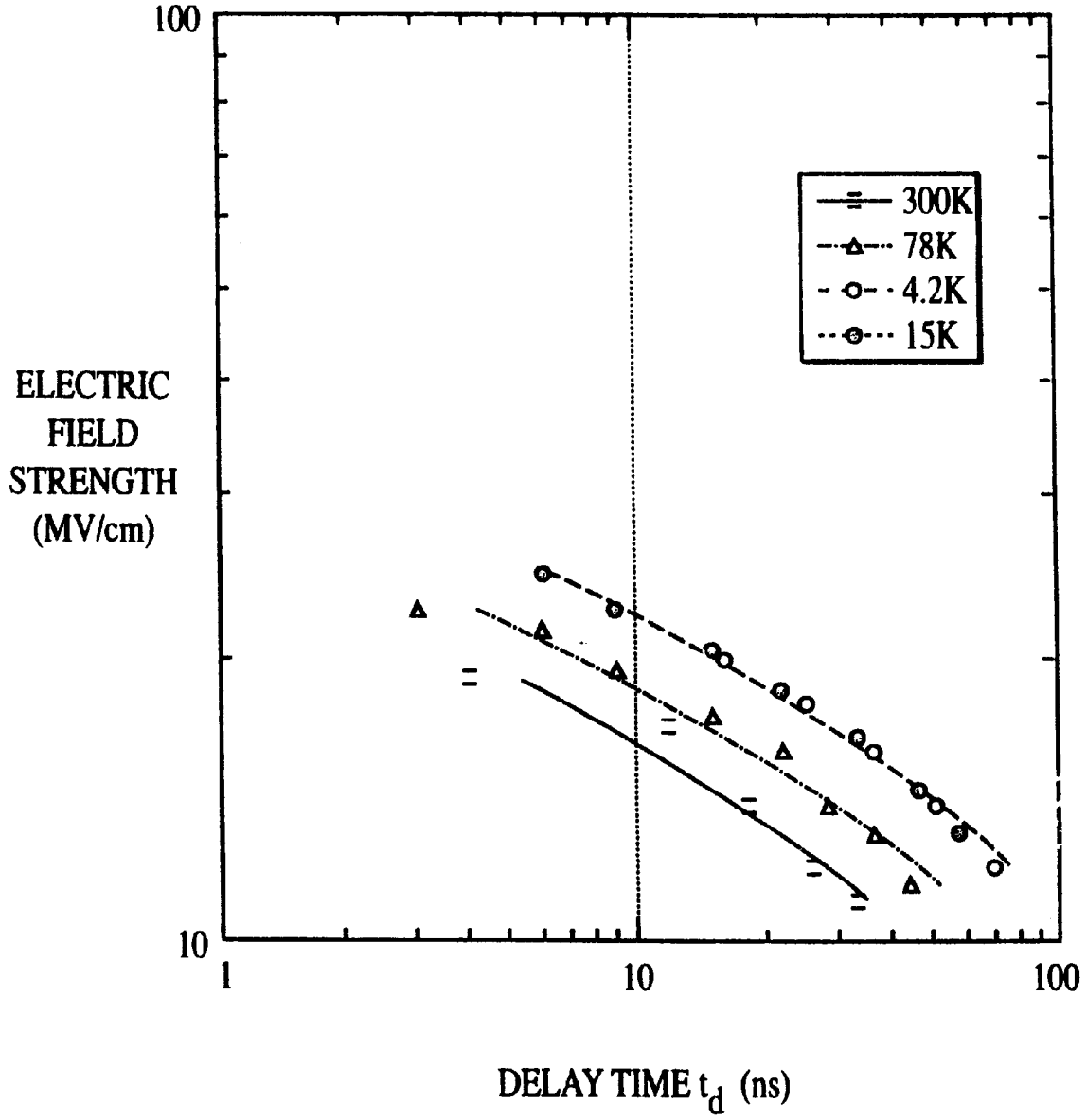
FIG. 2 is a graph showing the vacuum breakdown delay time versus macroscopic field for various Nb cathode temperatures.
Figure 3:
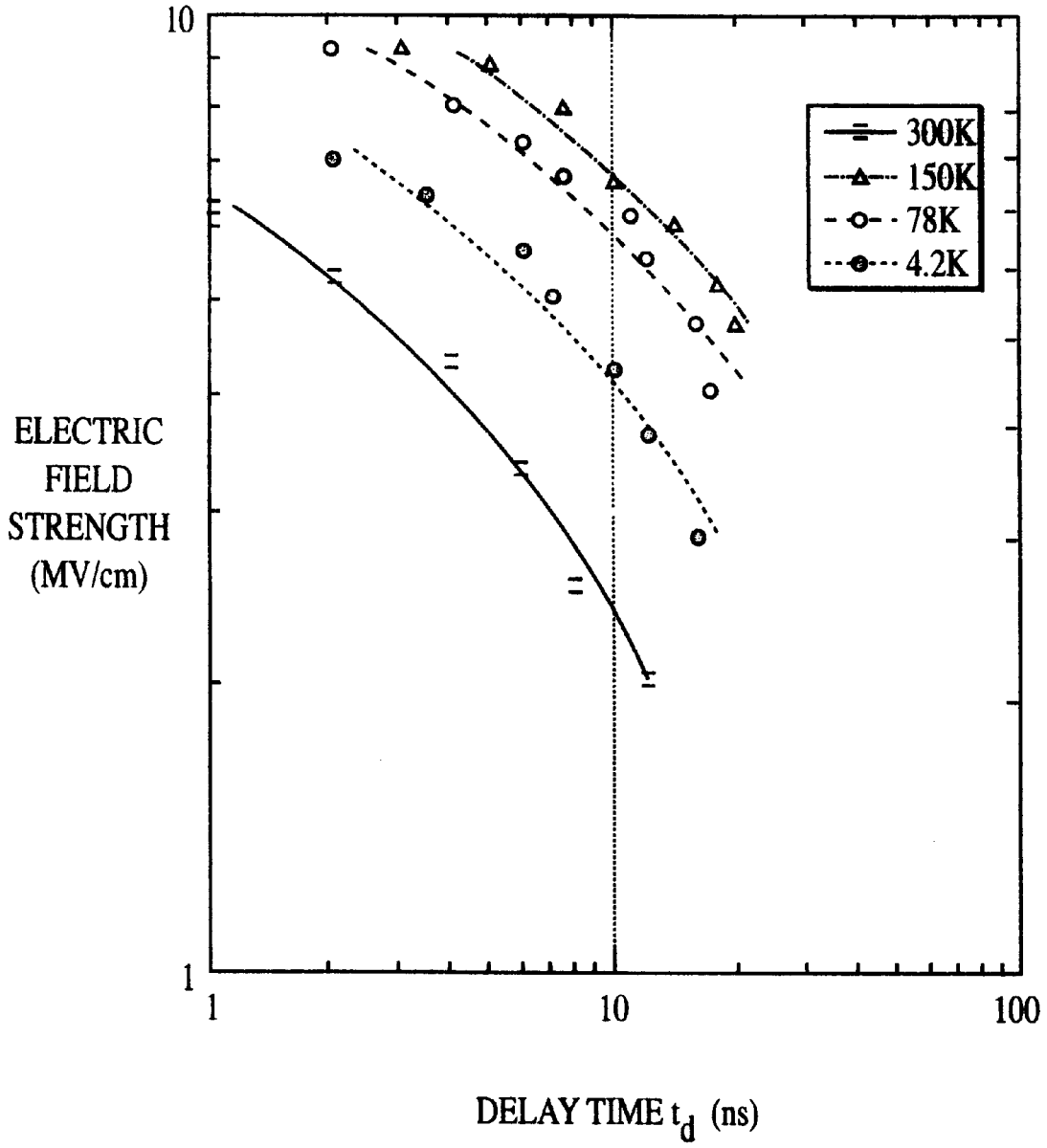
FIG. 3 is a graph showing the vacuum breakdown delay versus macroscopic field for a $Yba_2CU_3O_{7-x}$ extended cathode.

Data are available also for electrodes in the superconducting state, both conventional and high temperature superconductors (HTSC). See FIGS. 2 and 3, and S. I. Shkuratov, *IEEE Transactions on Dielectric and Electrical Insulation*, Vol.2, No. 2 (April 1995). The field breakdown of HTSC is not as high as the breakdown field of refractory metals, but still much higher (by almost a factor of 20) than fields obtainable with RF. Again, a dependence of the maximum field on pulse lengths can be seen clearly.

3) Breakdown Limits in Superconductors

At very high electric fields, the magnetic field associated with the RF or the pulse could exceed the critical magnetic field ($H_c$) of the material. If this happens, the material will become normal (non-superconducting). An example: a fast pulse travels in a coaxial structure. If the electric field in the structure is E, and the wave is traveling in vacuum, the ratio E/B is equal to the speed of light. For a field of 3 GV/m, the associated magnetic field is 10 Tesla. This field exceeds the critical field of any known "conventional" superconductor. The value of $H_c$ is not the only factor limiting the electric field in a superconducting structure. Other phenomena, limit the current carrying capability of HTSC to values close to 100 A/cm at a temperature not far below the normal to superconducting transition.

The properties of HTSC as RF power handling are being explored at present in many laboratories. Relatively high power devices for microwave operation up to about 60 Ghz have been fabricated in a HTSC (N. Newmann and W. G. Lyons, *J. Superconductor*, Vol. 6(3), pp. 119–159 (1993)).

4) Single Pulse versus Pulse Train.

There are a few ways to generate high voltage pulses of very short duration (nanoseconds to tens of picoseconds) by switching and pulse forming networks or structures. These techniques allow single pulses to be generated, but generally not at high repetition rate. Especially for very short pulses, in the tens of picoseconds region, the maximum repetition rate may not exceed a few hundred per second. For many applications, this repetition rate is not sufficient or appropriate. For instance, in the case of the free electron laser, one would like a repetition rate of the electron bunch to be of the order of the light round trip time in the optical cavity. This allows for the build up of radiation in the laser cavity, and generates a very narrow line of the laser emission.

It is possible, but not demonstrated experimentally, that very short pulses with a large time interval between pulses (large compared to the pulse duration) have the same breakdown characteristics as a single isolated pulse. In other words, after the application of a single pulse, there are mechanisms that allow the structure to "remember" previous application of high field. In general, the "memory" of the system should be limited to the lifetime of excited stated in the X-ray range, plus some low probability effects like plasma recombination with light emission in vacuum, and the existence of metastable states (in the residual gas). The slowest (longest memory) mechanism could be due to the presence of heavy ions of very low (almost thermal) energy. These ions may extract electrons from the metallic surfaces. This "permanence" time can be as long as a few microseconds.

Construction of a Pulse Train in Accordance with the Present Invention

1) Fourier Transform

A general mathematical theorem states that any continuous periodic function can be represented by a sum of orthogonal periodic functions, each periodic function with an appropriate coefficient. An example of this expansion is the sine (or cosine) Fourier series, viz:

$$f(t) = \sum_k a_k \sin k\omega t \tag{8a}$$

$$f(t) = \sum_k a_k \cos k\omega t \tag{8b}$$

k is an integer going from k=1 to k=∞. The frequency ω the fundamental periodicity of $f(t)$.

The function $f(t)$ is represented approximately by a finite number of terms, since the value of $a_k$ decreases for large values of k, for any reasonable waveform. Eqs. 8a, 8b are valid for any arbitrary periodic $f(t)$. This means that one can reconstruct bipolar pulse shapes, i.e., pulses with a positive and negative component.

A first obvious observation is that the peak value of $f(t)$is simply the sum of the $a_k$ coefficients, for any number of terms (to prove this, just set t=0 in Eq. 8b).

Therefore the peak power of the pulse is given by:

$$V_p = \sum_1^n a_k; \tag{9}$$

$$P_{peak} = \frac{V_p^2}{Z}$$

$$P_{peak} = \frac{1}{Z}\left(\sum_1^n a_k\right)^2;$$

The average power of each sine (cosine) functions is:

$$P_{avg}^{(k)} = \frac{1}{Z}\frac{1}{2}a_k^2 \tag{10}$$

Let us define a power compression ratio $C_n$ as the ratio between the peak power of the pulse and the sum of the average power in the n sinusoidal frequencies: an approximation to $C_n$ is 2n, as it will be seen later. In fact, the coefficient $a_k$ is of the order of t/T, up to a significantly large value of k.

As an example, consider a symmetrical triangular wave coefficients:

$$a_k = 2\frac{t}{T}A\left(\frac{\sin k\pi\frac{t}{T}}{k\pi\frac{t}{T}}\right)^2 \tag{11}$$

T is the time interval between two adjacent (short) pulses of length t at the base. A is the peak amplitude of the pulse, which will be taken as unity from now on. Another pulse shape (exponential) has the following coefficients:

$$a_k = \frac{2t}{T}\left[\frac{1}{1+\left(\frac{2t}{T}\right)^2\pi^2k^2}\right] \tag{12}$$

It can be shown that a pulse of duration t repeated at a time interval T takes T/t terms to be represented with good approximation; and that the compression ratio, as defined in Eq. 10, is indeed 2T/t.

From Eq. 12, the number of terms can be estimated, i.e., the value of k, for which the harmonic amplitude is reduced by 1/a (a much greater than 1).

$$k = \frac{T}{2\pi t}\sqrt{a-1} \tag{12 bis}$$

For a=20 (i.e. the amplitude of these harmonics is less than 5% of the fundamental), T/t=400, about 278 terms are required. If the sum is truncated at 100 terms, the pulse shape is still more than acceptable.

The following sections set forth some practical examples of pulse construction in accordance with the present invention. It should be understood that these are examples only, and that many other shapes and intervals are possible and will become apparent to those skilled in the art.

EXAMPLE OF PULSE CONSTRUCTION

Generation of the Set of Frequencies.

The number of frequencies needed to represent the pulse shape of duration t at the repetition rate T depends essentially on t/T, and to the degree of approximation to the actual waveform that is needed by the particular application. There are many ways to generate these frequencies, at low power. Successive amplification of the low power sinusoid (possibly with variable gain) will be used to obtain the final amplitude of each harmonic. The amplified harmonics will be added to produce the final waveform.

One of the many possibilities utilizes only two kinds of devices: mixers and frequency multipliers (dividers). Mixers are devices with two inputs, of two different frequencies, and two outputs, consisting of the sum and the difference of the two frequencies. Frequency multipliers (dividers) are devices with one input, of a certain frequency, and one output, consisting of a frequency twice the input frequency (or half the frequency for the dividers). Assume a total of 256 harmonics, for T/t=512 (i.e., $2^9$). Let the lowest frequency be Ω, the highest will be 256 (i.e. $2^8$) Ω. Using the frequency of 128 (i.e. $2^7$) Ω as a starting frequency, the dividers will produce the frequency values (in Ω units) of 64, 32, 16, 8, 4, 2, 1 (seven dividers). One multiplier will generate the frequency of 256. Summing and subtracting the frequencies above will generate all other frequencies. Dividers could be used as well: for example the frequency 48 Ω could be generated by summing 64+32 and dividing by two, or by summing 32+16. There are minimal nets (that is, nets containing a minimum number of components) capable of generating all the required harmonics, and the actual net will be decided by considerations of frequency stability, phase stability, amplitude sensitivity, and cost/quality of the components. All of the 256 frequencies may need filtering before amplification, to insure that a pure sinusoid is amplified before being summed on the load. Conversely, adjusting the gain of the (following) amplifying stages can compensate the amount of harmonic distortion. The phase, amplitude and purity of each harmonic can be controlled by a microprocessor that feeds back the results of a measurement of each quantity for every harmonic. Finally a narrow bandwidth tuned filter in series with a power amplifier will protect the amplifier itself from the high voltage pulse, by allowing only one frequency to reach the amplifier output.

Amplification

The harmonics are generated at low power level and will be amplified by different components, depending on the range of frequencies, and the power level. This is a practical engineering task, easily solved by those skilled in the art. Suffice to say that solid state (MOSFETS or bipolar) are available at present up to few gigahertz, for power of the order of 100 watts. Vacuum tubes, triodes or tetrodes, are available up to a few gigahertz, for power levels much larger than the power available from solid state devices. This is especially true for pulsed system, i.e., for systems in which there is a burst of pulses, repeated at some interval much longer than the duration of the burst.

As an example, suppose a 1 MV pulse of 0.1 ns duration, repeated every 40 ns, on an impedance of 377 ohms, is needed. Each pulse has an energy of 0.265 Joules. The peak power of the pulse is 2.65 gigawatts, and the average power of the pulse train, if continuous, is 6.6 megawatts. This average power is obtained by adding 256 sources. Therefore each source will supply roughly 26 kilowatts. If bursts of hundred pulses are repeated at a rate of 100 times/second, the average power of the pulse train will be 2.6 kilowatts.

The actual circuitry necessary for this task depends upon the number of harmonics needed to approximate the pulse shape, pulse duration and repetition rate, and the power level. Power combiners are available commercially, in a broad range of power levels, frequencies, number of channels combined, etc. They are used, for example, when a single antenna is used to broadcast different transmitting stations. All of these elements are designed to combine power from different sources onto a load, or inversely as splitters, i.e., as devices to send power to different loads from a single source. Some combination of frequencies can be obtained at the amplification stage: the harmonics are synthesized at low power, and further amplified using (for instance) high frequency vacuum tubes. The grid of each vacuum tube can be driven with an admixture of different frequencies, appropriately chosen in order to compensate for phase, amplitude, distortion and gain at different frequencies. The number of frequencies, their distribution among different amplifiers etc. is a matter of good design practices in high power radio frequency electronics. The same criteria can be used if the pulses are relatively low power, in which case solid state amplifiers will replace vacuum tubes. Most likely the use of solid state amplifier will limit the maximum obtainable. If the mixing is done on low impedance, the final voltage can be increased by transforming up either the final pulse train or each individual harmonic.

Low Power on Low Impedance, Non Resonant Structures.

Figure 4:
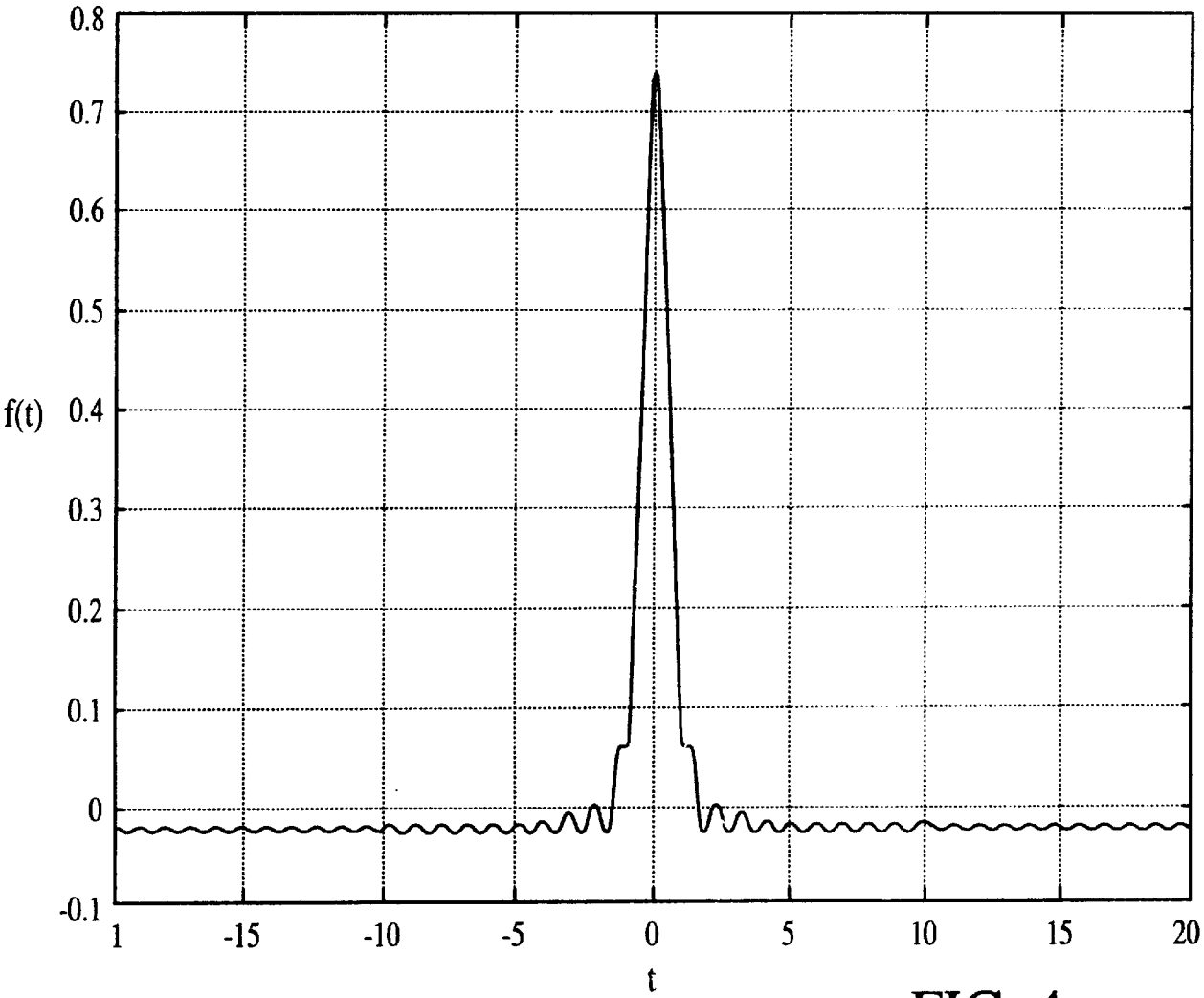
FIG. 4 is a graph showing the pulse shape for a combination of 40 harmonics.
Figure 5:
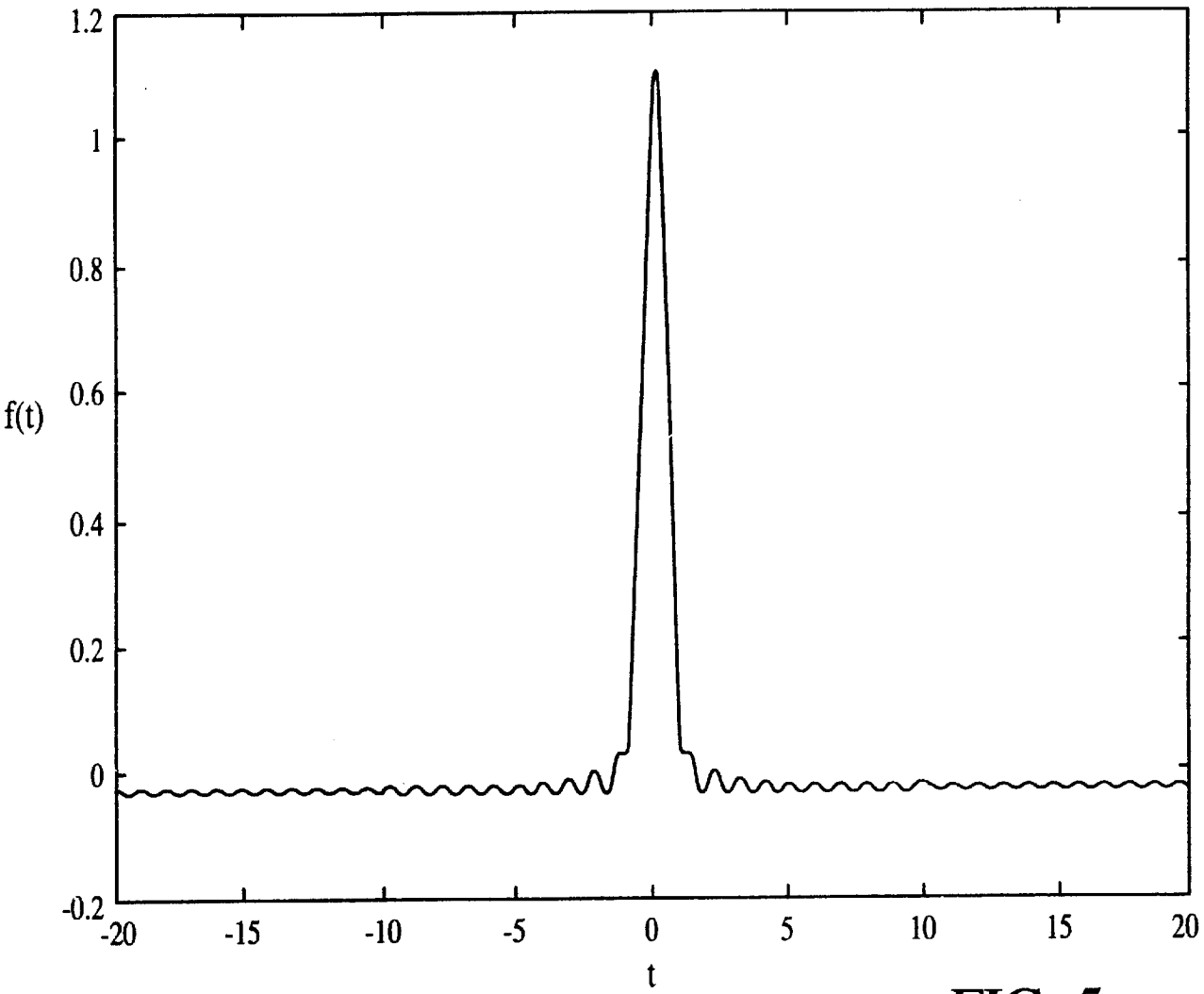
FIG. 5 is a graph showing the pulse shape for a combination of 60 harmonics.
Figure 6:
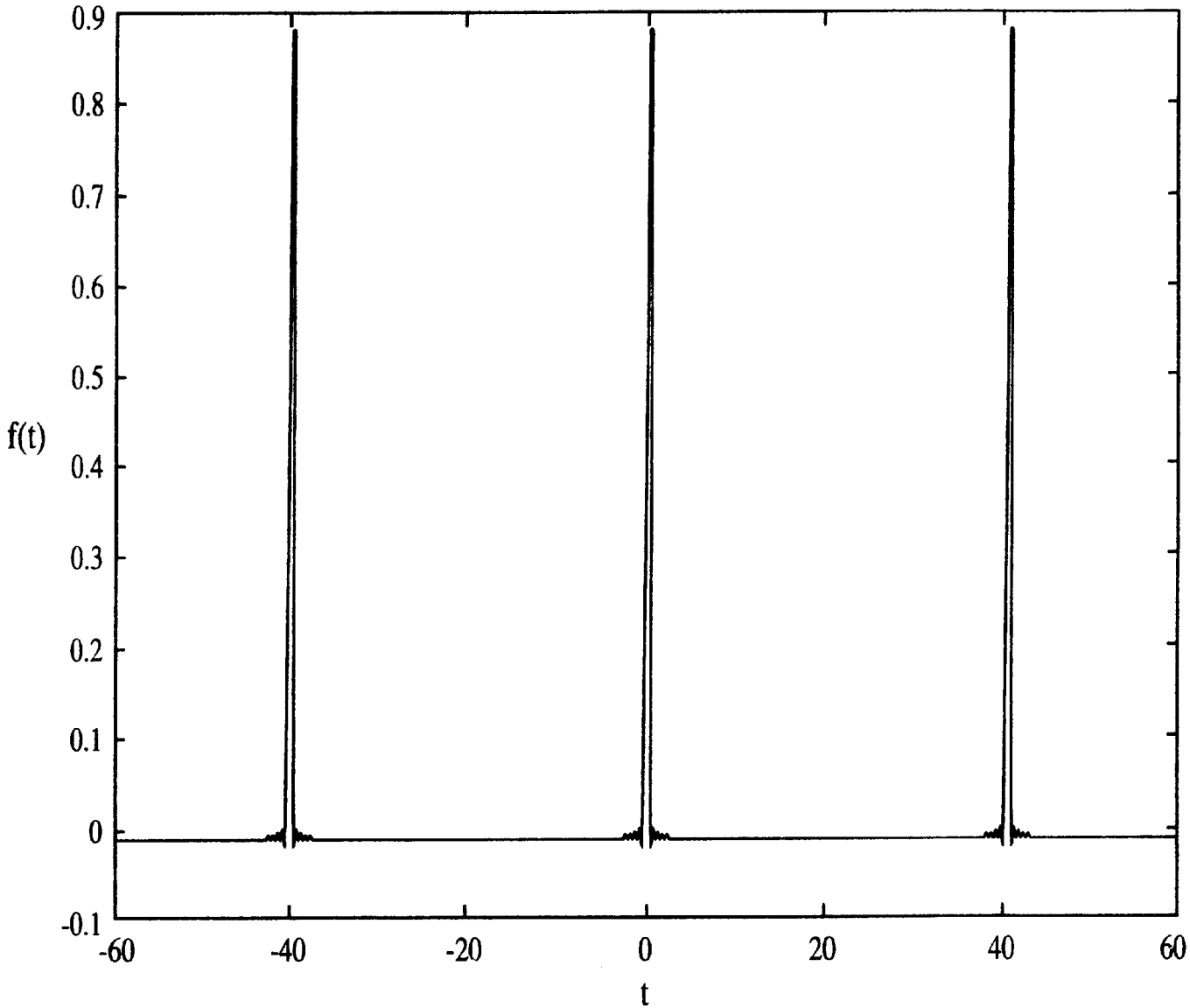
FIG. 6 is a graph showing the pulse shape for a combination of 80 harmonics (3 pulses are shown in succession).

Commercially available generators of repetitive pulses (also called comb generators) are capable of output voltages of a few hundred volts. Repetitive high voltage pulses generators are in the field of pulse power electronics, and can produce pulses of a few tens of nanoseconds, with spacing from the "square wave" (pulse duration equal to pulse spacing) to the "comb generator", where the pulses are spaced by a time much longer than their pulse length. Electronic components' specifications limit the pulse height, for short pulse duration, at the level of a few nanoseconds. Furthermore each pulse shape is dictated by the particular switch and following pulse-forming network (in some cases the pulse shape can be modified, but only within a narrow range). Instead, by combining different frequencies, an arbitrary shape and repetition frequency with an arbitrary precision can be generated. A practical example is described here. For simplicity, assume that the mixing is done on 50 Ohm load. The objective is to generate an exponential waveform, limiting the sum to 40 terms, with t/T=100. From the amplitude spectrum, an amplitude of 0.04 for the fundamental harmonic is obtained, and for the 40th harmonic, an amplitude of 0.005. When all the (40) amplitudes are added, the result is a pulse height of 0.75. To obtain a 1 kV pulse on 50 ohms, a first harmonic of 0.053 kV, or 53 V is needed. The last (40th) harmonic will be 6.6 volts. If a repetition rate of 20 MHz (50 ns pulse to pulse spacing) is chosen, the pulse length will be (nominally) 0.5 ns; the 40th harmonic will be 800 MHz. These are frequencies well within the capabilities of silicon devices (RF transistors or FET), up to the highest harmonic. The average power for the highest harmonic will be 0.43 watts, whilst the power at the lowest frequency will be 28 watts. The peak power of the pulser will be 20 kW, and the average power 200 Watts, which is equal to the sum of the power of all harmonics. Finally, the pulse shape will be as in FIG. 4, with 40 harmonics added. If 60 harmonics are added, the pulse shape will be as in FIG. 5. Adding 80 frequencies the resulting pulse shape will be as in FIG. 6.

Figure 7:
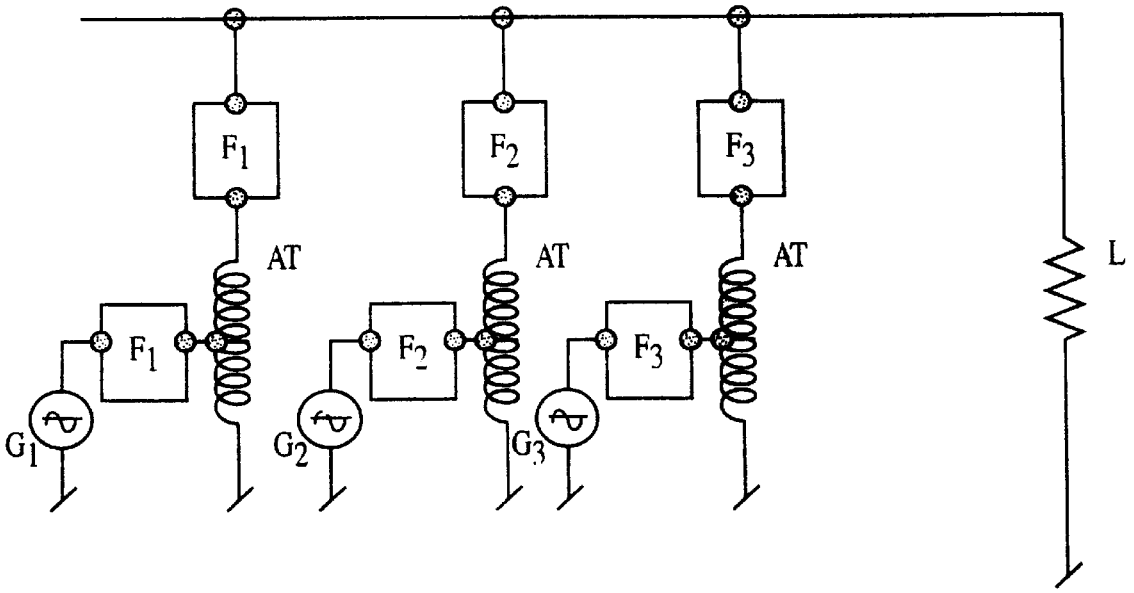
FIG. 7 shows a diagram of a circuit for combining the component frequencies in accordance with the present invention.

The combination of each individual component can be done via a transformer (FIG. 7), whose primary and secondary are tuned (resonate) on the same frequency of the oscillator driving the load L. This is represented symbolically by two filters, on the primary and secondary respectively. The tranformers are represented as autotransformers in FIG. 7. The transformer ratio is established by considering the particular waveform required at the load L.

High Voltage, High Peak Power (for accelerators)

The choice of the triangular or exponential shapes are just examples. In fact, any arbitrary periodic function can be constructed to fit the requirements of the particular application. In an open structure accelerator, like the one described in U.S. Pat. No. 4,893,089, the requirement is a bipolar pulse, or a pulse that approximately reproduces one cycle of a sinusoid at very high frequency. It is relevant to point out again that the harmonic mixing technique allows any arbitrary pulse shape to be reproduced, just by changing the amplitude of the harmonics.

Another interesting feature of the Fourier combination is that it is possible to compensate for beam loading (longitudinal wakefield compensation). In conventional accelerators, this is done approximately by changing the phase of the electron bunch with respect to the phase of the radio frequency, so that the head of the bunch acquires a different energy than the tail. Especially in the first stages of acceleration, where the initial high current acceleration occurs, it may be necessary to raise the (unloaded) field, so that the longitudinal emittance stays low. The electric field must change in a time comparable to the length of the bunches. For multiple bunches acceleration, the pulse to pulse compensation will improve the energy spread (i.e. the longitudinal emittance).

Combining on a Resonant Load.

The load will be resonant at the lowest harmonic. As an example, for an interpulse spacing of 20 nanoseconds, a cable of a length of 6 meters (if vacuum insulated), open at both ends, will resonate at 50 megahertz. In the language of pulses, a fast pulse will travel back and forth, being reflected at both ends of the cable. Therefore in any point of the cable length a pulse repeating at the rate of 50 megahertz will be seen. This particular configuration can be used when the load of the pulser is much greater than the impedance of the cable.

Combining on a Resonant Load With Frequency Dependent Gain. Mixing in an Ultra-Flat Cavity.

There is a case where the gain is frequency dependent, the pulse shape will be distorted while it traverses the resonant load. The frequency dependence of the gain can occur because of losses, or because the structure leads to energy compression.

One of the structures suggested for short pulse acceleration is the radial line. Normally it is composed of two parallel disks, with a small hole in the center. This structure is periodic, and in one embodiment it was open at the outer edge, to allow a fast pulse to be induced by an electron beam. The experiment was not successful, because (among other reasons) of instability of the driving electron beam.

If the radial line is closed at the outer edge, it becomes a cavity, just like the conventional cavities of a linear accelerator. The difference between the radial line and a conventional cavity is in the ratio of gap to radius: of the order of 1 for conventional cavities, of the order of hundred or more for the radial line transformer. This very large ratio is the reason for a pulse voltage gain, G (ratio between the field at the edge of the radial line to the center of the radial line) approximately given by:

$$G = \sqrt{\frac{2R}{\tau_c + g}} \tag{14}$$

where $\tau_c$ is the product of the rise-time of the pulse times the speed of light, R is the radius of the radial line, g the gap (longitudinal dimension of the radial line). For sinusoidal excitation, the field intensity at the center of the line is higher than the intensity at the periphery. This increase is proportional to $\sqrt{v}$, v being the frequency. This can be seen by inspecting the expression for the longitudinal electric field as a function of r, ($0 \leqq r \leqq R$), obtained by solving Maxwell equations exactly. Assume that a set of frequencies representing a short pulse are injected at the periphery of the line. The low frequencies will not be amplified appreciably, while the high frequencies components will grow in amplitude. Basically each coefficient of the expansion (12)

$$a_k = \frac{2t}{T}\left[\frac{1}{1 + \left(\frac{2t}{T}\right)^2 \pi^2 k^2}\right] \tag{14}$$

Will change to $$a_k \rightarrow a_k \sqrt{\frac{k v_0}{v_0}} = a_k \sqrt{k} \tag{15}$$

where $v_0$ is the first resonant frequency. Successive harmonics have integer multiple frequencies (k is an integer), hence the coefficients in the center of the radial line will be given by Eq. 13. This will have the effect of distorting the pulse shape towards a faster rise, and to give an amplitude gain which can be approximated by Eq. 14. Conversely one could induce in the radial line periphery a set of amplitudes $a_{k \rightarrow} a_k/\sqrt{k}$. In this case the pulse shape in the center will be the exponential shape corresponding to Eq.12. The advantage is the fact that high frequencies will require much less power (each by a factor of k).

The resonant frequencies of a flat radial line are equally spaced after the first few harmonics. The resonant frequency for the TEM modes is given by:

$$f^2 = \frac{X_{ij}}{a} + \frac{m\pi a}{l} \tag{16}$$

For any flat cavity, there are many more resonant modes, not useful for acceleration. In these modes, the electric field is not in the right (longitudinal) direction, or they are not maximal in the center. Since only modes with the electric field maximum in the center of the cavity are desired, the structure may have to be built so that tangential currents are not sustained. This can be obtained by sectioning the disks in the radial direction, which will prevent currents to flow in the orthogonal (to the radial) direction, therefore damping most of the unwanted modes. In this case, the geometry of the radial line will be reduced to a large number of two sided lines converging to the center, capacitively coupled at the edges.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method of accelerating particles, comprising the steps of:

generating a high frequency train of high voltage short pulses by combining a plurality of harmonic amplitudes to construct said pulses, via a Fourier construction, in a desired shape; and applying said high frequency train of high voltage short pulses to an accelerating structure for accelerating said particles, each of said plurality of harmonic amplitudes forming said high frequency train of high voltage short pulses being connected to the accelerating structure by an impedance matching transformer being provided with input side and output side resonant filters.

2. A method of accelerating particles as recited in claim 1, wherein said particles comprise electrons.

* * * * *